US005303507A

United States Patent [19]

Oille

[11] Patent Number: 5,303,507

[45] Date of Patent: Apr. 19, 1994

[54] ADJUSTABLE SHUTTERS AND SLATS THEREFOR

[75] Inventor: Fred J. Oille, Mississauga, Canada

[73] Assignee: Fashion Fold Products Inc, Rexdale

[21] Appl. No.: 49,336

[22] Filed: Apr. 21, 1993

Related U.S. Application Data

[63] Continuation-in-part of Ser. No. 970,424, Nov. 2, 1992, abandoned.

[51] Int. Cl.[5] ..... E05F 17/00

[52] U.S. Cl. ..... 49/74.1; 49/92.1; 49/403; 160/236

[58] Field of Search ..... 49/74.1, 92.1, 403, 49/371, 87.1, 64; 454/221, 224, 278; 403/292, 298, 359; 160/172, 236

[56] References Cited

U.S. PATENT DOCUMENTS

| | | | |
|---|---|---|---|
| 279,111 | 6/1883 | Vandervoort | 49/87.1 |
| 2,230,707 | 2/1944 | Wallace | 189/62 |
| 2,549,314 | 4/1951 | Kegley | 49/371 |
| 2,761,185 | 9/1956 | Sherwood | 49/74.1 |
| 2,822,587 | 2/1958 | Hallock | 49/92.1 |
| 3,031,013 | 4/1962 | Russell | 49/403 |
| 3,031,045 | 4/1962 | Hallock | 160/236 X |
| 3,110,936 | 11/1963 | Berard | 49/92.1 |
| 3,527,486 | 9/1970 | Gamp | 403/298 X |
| 4,103,601 | 8/1928 | Dayus | 49/74.1 |
| 4,545,294 | 10/1985 | Dayus | 160/236 |
| 4,643,081 | 2/1987 | Vicinanza et al. | 454/278 |
| 4,655,003 | 4/1987 | Henley | 49/74.1 |
| 4,889,040 | 12/1989 | Man | 49/92.1 |
| 5,001,864 | 3/1991 | Truscott | 49/74.1 |
| 5,187,896 | 2/1993 | Ross | 49/74.1 |

FOREIGN PATENT DOCUMENTS

| | | | |
|---|---|---|---|
| 441593 | 5/1922 | Fed. Rep. of Germany | 49/64 |
| 372154 | 11/1963 | Switzerland | 49/74.1 |
| 3200 | of 1888 | United Kingdom | 49/64 |
| 1010789 | 11/1965 | United Kingdom | 49/64 |
| 9010777 | 9/1990 | World Int. Prop. O. | 49/403 |

*Primary Examiner*—Peter M. Cuomo
*Assistant Examiner*—Jerry Redman
*Attorney, Agent, or Firm*—Kenneth M. Garrett

[57] ABSTRACT

A slat for a shutter is in the form of a hollow, flat tube. The slat is connected to a tubular adjusting rod by a swivel connector which comprises a pair of hook elements and a serrated body portion from which each of the hook elements is supported. The slats and the adjusting rod are each provided with openings into which the body portion of the swivel connector is inserted. Splines locating within the slat and the adjusting rod engage the serrations and lock the swivel connector in position. The shutters may also incorporate an anti-sag support for retention when in their closed position.

20 Claims, 6 Drawing Sheets

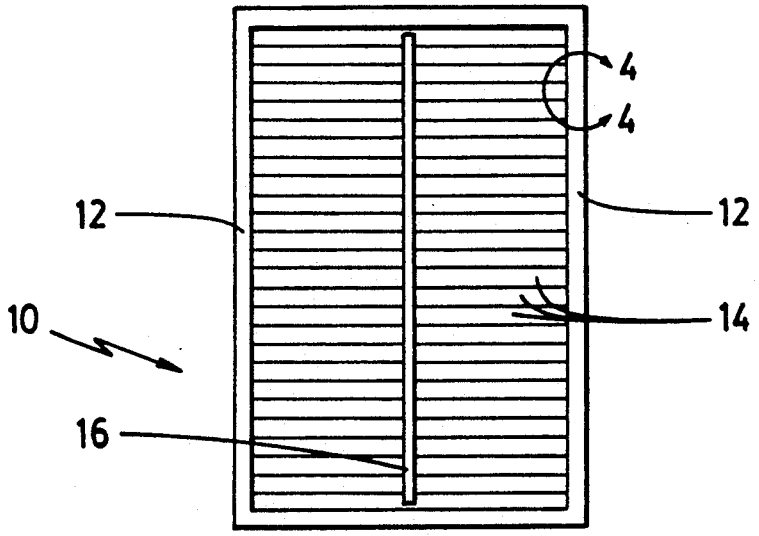
FIG. 1
FIG. 2
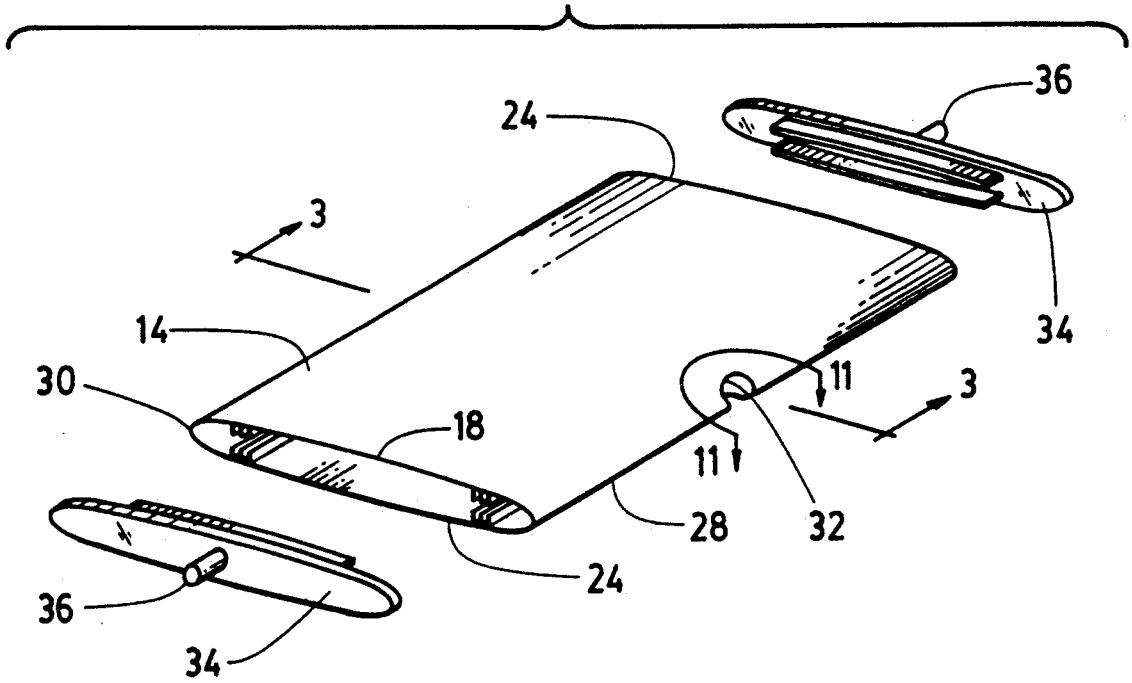

ADJUSTABLE SHUTTERS AND SLATS THEREFOR

RELATED APPLICATION

This application is a continuation-in-part of U.S. patent application Ser. No. 970,424 filed Nov. 2, 1992, now abandoned.

FIELD OF INVENTION

This invention relates to improvements to shutters. Such shutters comprise a frame and a plurality of slats pivotally supported from the frame, and means for adjusting the angle to which the slats are pivoted so as to control the amount of light passing through the shutter. The invention also relates to improvements to slats, used to form shutters, and in shutter assemblies including a jamb and lintel frame from which the shutters are hingedly supported in a manner to prevent sagging.

BACKGROUND OF INVENTION

Traditionally, slatted shutters have been made from wood. There have been a number of previous proposals to substitute other materials, with a view of reducing cost and also in providing some structural advantage, the following being exemplary:

U.S. Pat. No. 2,230,707 (Wallace) discloses hollow slats which are pressed from sheet metal.

U.S. Pat. No. 3,031,013 (Russel) discloses hollow slats that are formed from a pair of plastic sheet members joined together along their edges.

Generally speaking, the means for adjusting wood shutters has consisted of an adjustment rod which is connected to an edge of each slat with a pair of U shaped tacks linked together. Such method of adjustment is not readily adaptable for use where the shutters are made from a hollow non wood-like material. The shutters are normally employed in a shutter assembly in which they are hinged to the jamb of a surrounding frame. Where the shutters are formed from plastic materials, sagging is noticeable over a period of time, and is aesthetically objectionable.

It is an object of this invention to provide slats and shutters incorporating such slats, that are particularly suited for construction from plastic materials.

It is another object of this invention to provide shutters which incorporate means that are particularly adapted to couple an adjusting rod to the slats of the invention.

It is yet another objection of the invention to provide hinged shutter assemblies which include means for reducing sagging of the shutters.

SUMMARY OF THE INVENTION

In accordance with one aspect of the invention, a slat has a tubular wall which is defined in transverse cross-section by a major axis and a minor axis. The tubular wall has an opening therethrough concentered on the major axis. The tubular wall has a plurality of splines aligned with the length of the slat internally thereof, on opposed sides of the major axis and in proximity to the opening. has a plurality of splines aligned with the length of the slat internally thereof, on opposed sides of the major axis and in proximity to the opening.

Suitably, the splines are coextensive with the length of the slat, the slat being particularly amenable to formation as a plastic extrusion, it being understood that the opening therein is formed as a subsequent operation.

Preferably, the slat will have a two fold plane of symmetry other than in respect of the opening, which is to say that other splines which are the mirror image of those mentioned above will also be provided.

The adjusting rod also has a tubular wall, and has a plurality of openings therealong, each opening having a center residing in a plane generally bisecting the rod; a plurality of splines are inwardly depending from the tubular wall of the adjusting rod on opposed sides of the bisecting plane and generally transverse thereto. Suitably and preferably these splines will be coextensive with the length of the adjusting rod, this being suitably formed as an extrusion, again it being understood that the openings therein will be formed in a subsequent operation.

Preferably the tubular wall of the adjusting rod will have a transverse cross-section which is defined in part by a major axis which resides in the bisecting plane and a minor axis transverse thereto.

The adjusting rod is coupled to the slats by a coupling means, one such means being associated with each opening formed in the slat and a corresponding opening formed in the adjusting rod.

The coupling means has a central hinge and a pair of serrated portions connected by the hinge. The serrated portions are respectively inserted into an opening of a slat and the associated opening of the adjusting rod to engage the splines with the serrations.

The insertion of the serrated portion into engaging relationship with the splines of the slat is preferably performed while a compressive force is exerted on the slat along the major axis thereof. This has the effect of resiliently ballooning the slat whereby opposed splines spread apart, thereby facilitating the passage of the serrated portion between the splines. When the compressive force is removed, the splines firmly trap the serrated portion in position. The serrated portion is similarly engaged with the splines of an adjusting rod when the latter is deformed with a compressive force applied along the major axis.

Preferably, the hinge comprises two matable parts respectively connected to serrated portions, at least one of these parts comprising a hook element. The serrated portions are engaged with the splines in the above manner prior to coupling the hook element to its mating part. The compressive force is maintained on the slats and on the adjusting rod until such time as the hook element is coupled to its mating part to form the hinge. Upon releasing the compressive forces, the hinge becomes partially surrounded by the slat, thereby inhibiting the uncoupling of the hook element from its mating part.

In accordance with the preferred embodiment, the mating part is also a hook element, and the coupling means consists of two identical parts.

The shutter assembly of the invention includes a pair of jambs and a lintel forming an assembly frame, and a shutter secured to a jamb by hinges so as to be movable between open and closed positions. Clip means is provided for releasably supporting from the lintel a side of the shutter remote from the hinges when the shutter is in its closed position. Suitably the clip means comprises a bracket secured to the shutter and a support plate secured to the underside of the lintel in spaced apart relationship.

These foregoing objects and aspects of the invention, together with other objects, aspects and advantages thereof will be more apparent from the following description of a preferred embodiment thereof, taken in conjunction with the following drawings.

BRIEF DESCRIPTION OF THE DRAWINGS

FIG. 1 shows a shutter in front elevation;

FIG. 2 shows a slat from the shutter of FIG. 1 in exploded, perspective view;

DESCRIPTION OF THE PREFERRED EMBODIMENT

Figure 3:
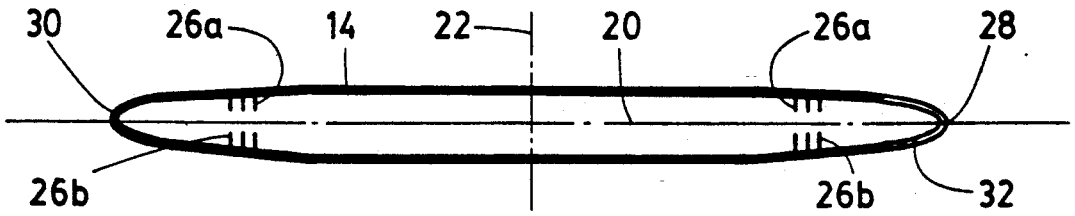
FIG. 3 is a schematic transverse cross section on line 3—3 of FIG. 2.
Figure 4:
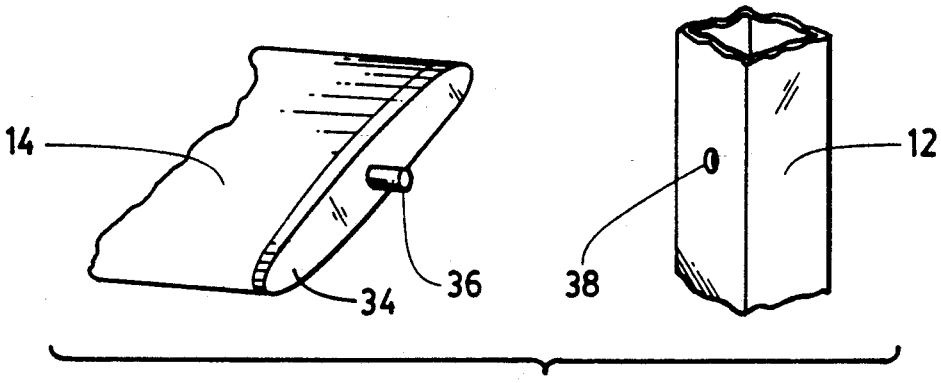
FIG. 4 is a fragmentary view of the shutters of FIG. 1 contained within the area 4—4 identified therein, shown in perspective, exploded view.

Referring to the drawings in detail, a shutter is identified therein by the numeral 10. Shutter 10 comprises a frame 12, a plurality of slats 14, and a shutter adjusting rod 16 connected to slats 14 in a manner to be described.

Each of slats 14 is defined by a tubular wall 18 extending longitudinally between opposed ends 24. Slat 14 has a transverse cross section defined in part by a notional major axis 20 and a notional minor axis 22, typically the one axial dimension being approximately one order of magnitude greater than the other. As best seen in FIG. 3, and with reference to the orientation of the slat in that Figure, slat 14 has three splines 26*a* which depend downwardly from wall 16 internally of the slat adjacent one longitudinal edge 28 thereof, and three similar splines 26*b* which face splines 26*a*, the splines each being coextensive with the length of slat 14. Other splines 26*a*, 26*b* are also provided adjacent longitudinal edge 30, the slat 14 as thus far described having a two fold plane of symmetry in longitudinal planes containing the major and minor axes 20,22 of the slat. Slats 14 are conveniently formed as extrusions of indefinite length and chopped to length by any convenient means. The non-handed nature of slats 14 reduces operator errors in subsequent forming and assembly of the slats into a shutter. Splines 26*a*, 26*b* serve to stiffen the slats 14 longitudinally; the splines also tend to resist the collapse of the slats under forces having a component parallel to minor axis 22 thereof, as the splines move into interfering relationship under the influence of said force.

Slats 14 are provided with a small opening 32 formed through edge 28 concentered on major axis 20.

Shutter 10 includes means for pivotally mounting slats 14 in frame 12, which means includes end stoppers 34 each having a trunnion 36 disposed centrally thereon to project longitudinally outwardly therefrom, and which engages in an associated bearing opening 38 provided in frame 12.

Figure 5:
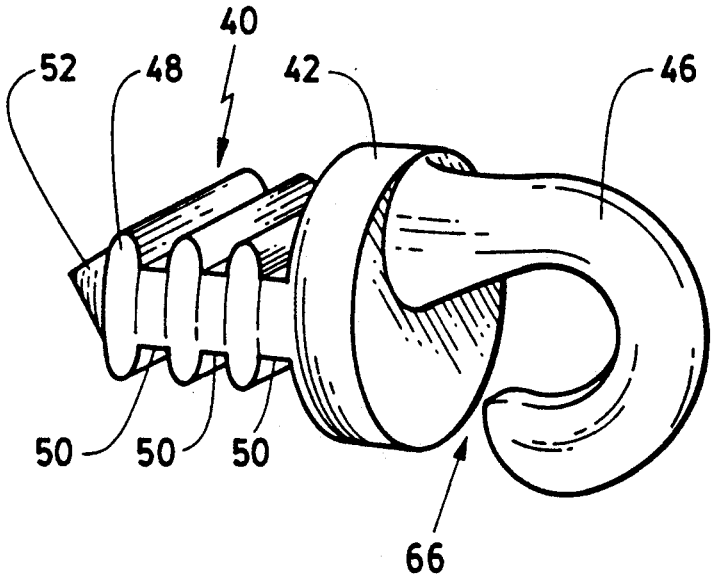
FIG. 5 shows in perspective view the connector part of FIG. 2.
Figure 6:
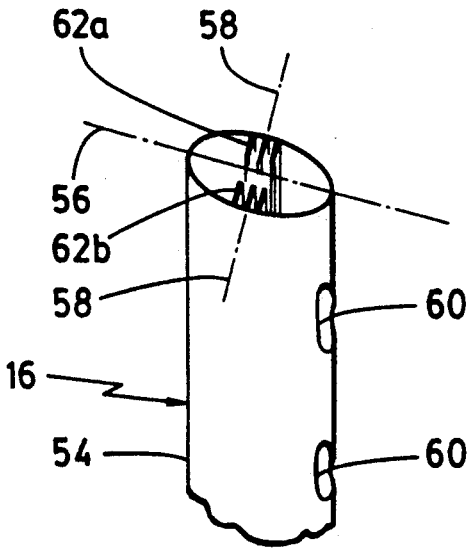
FIG. 6 shows in perspective view a small portion of the shutter adjusting rod of the shutter of FIG. 1.

Shutter 10 further includes a coupling means for coupling slats 14 to adjusting rod 16, which means comprises two identical parts, one of which is seen in FIG. 5 wherein it is identified by the numeral 40. Coupling member 40, includes a generally cylindrical end portion 42 having a diameter somewhat less than that of openings 32, a hook portion 46 extending axially forwardly of end portion 42, and a body portion 48 extending axially rearwardly of the end portion. Body portion 48 has a generally obround (i.e. oblong with rounded corners) transverse cross section, with a major axis of the cross section having a dimension approximately equal to the diameter of end portion 42. Body portion 48 is provided with three transverse serrations 50 on each of the two major faces thereof, which serrations are transverse to the plane containing hook portion 46. Body portion 48 is rearwardly convergent at the rearward end thereof, generally having a conical form 52 concentered on the cylindrical axis of end portion 42.

Adjusting rod 16 is generally tubular and is defined by a wall 54 having a generally oval cross section with a notional major axis 56 and a notional minor axis 58. A plurality of openings 60 each having a diameter similar to that of opening 32 are provided along wall 54, each of which openings 60 is concentered on axis 56. Three splines 62*a*, 62*b* project inwardly from wall 54 on opposed sides of axis 56, and extend generally coextensively with wall 54.

Figure 7:
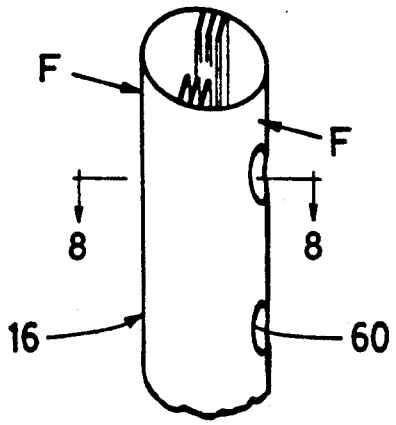
FIG. 7 is similar to FIG. 6, but shows the rod undergoing a deformation as the result of a compressively applied force.

To couple adjusting rod 16 to slat 14, a coupling member 40 is inserted into each opening 32 and 60 to engage serrations 50 with splines 26*a*, 26*b* or with splines 62*a*, 62*b* as the case may be. The insertion of the coupling member 40 into engaging relationship with an adjusting rod 16 is facilitated by supplying a compressive force F along the major cross section axis 56 thereof, as shown in FIG. 7, which acts to balloon the adjusting rod, and to thereby increase the spacing between opposed ends of splines 62*a*, 62*b*, whereby it is relatively easy to engage the splines with the serrations 50. It may be noted that conical end portion 52 of coupling member 40 will assist in deflecting splines 62*a*, 62*b* and that cylindrical end portion 48 will form a positive abutment to prevent the coupling member from penetrating too deeply into rod 16.

Figure 8:
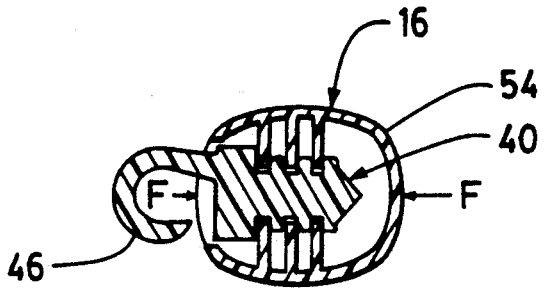
FIG. 8 shows a transverse cross section of the shutter adjusting rod on line 8—8 of FIG. 7, with the connector part of FIG. 5 in engaged relation therewith.
Figure 9:
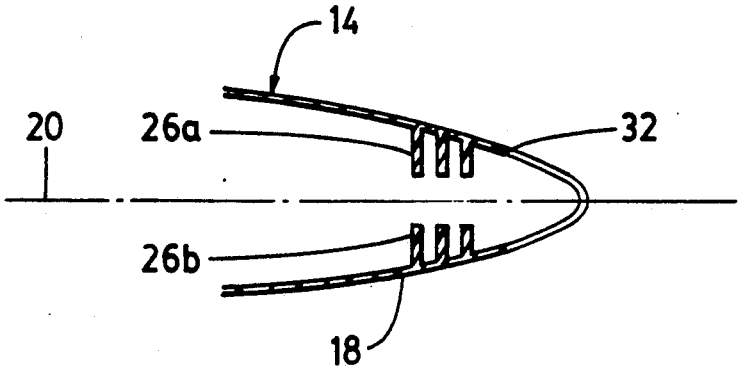
FIG. 9 shows the right hand portion of FIG. 3 in greater detail.
Figure 12:
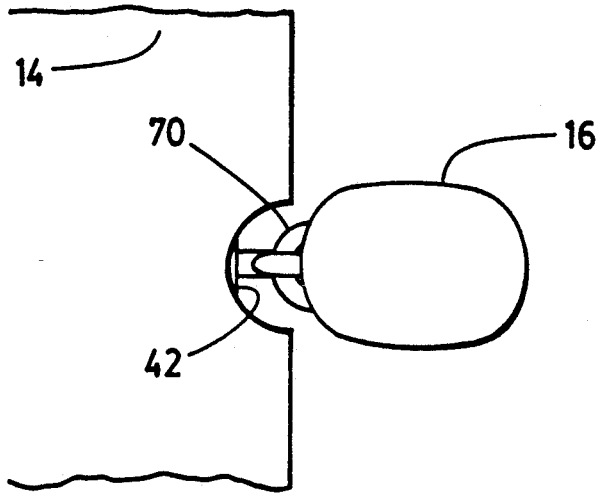
FIG. 12 is similar to FIG. 11 but shows the part upon the release of the compressive force following the assembly operation.

In FIG. 8, adjusting rod 16 is shown in its ballooned condition under the influence of the compressive force F, with connector part 40 in engaged relationship therewith. It should be remarked that when force F is removed from adjusting rod 16, wall 54 will tend to move inwardly along minor axis 58, and outwardly along major axis 56, which outward movement will tend to sheath hook portion 46 of connector part 40 within the envelope of wall 54, as seen in FIG. 12, whereby wall 54 defining an opening 60 will partially surround an associated hook portion 46. As a corollary of this, application of the compressive force F along the major axis 56 tends to expose hook portion 46.

Figure 10:
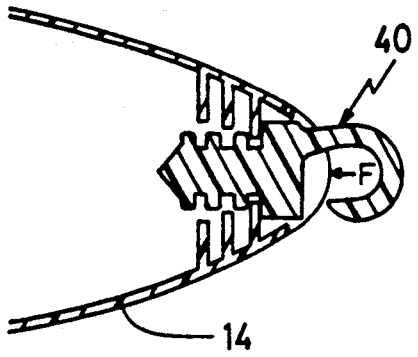
FIG. 10 is similar to FIG. 9 and shows the deformation of the slat under the influence of a compressively applied force, with the connector part of FIG. 5 in engaged relation therewith.
Figure 11:
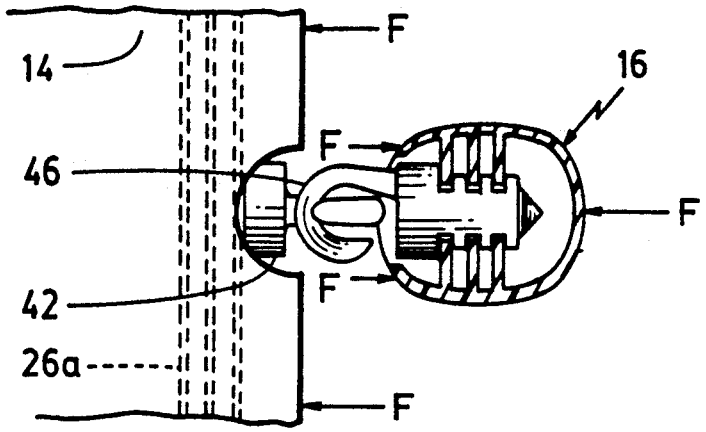
FIG. 11 is similar to FIG. 10, but as would be seen as to fragment 11—11 of FIG. 2, together with the portion of FIG. 8 engaged therewith.

The insertion of the coupling member 40 into engaging relationship with a slat 14 is facilitated by applying a compressive force F to the slat along the major axis 20 thereof in a manner that is wholly analogous to that just described in the case of adjusting rod 16. However, due to the relatively high ratio of the dimensions of the major axis 20 to the minor axis 22, the ballooning effect of the compressive force F will be considerably greater in the slat than is the case in the adjusting rod. Accordingly, hook portion 46 is almost entirely exposed when slat 14 is under the influence of compressive force F, as will be appreciated from FIGS. 10 and 11. This permits a corresponding hook portion 46 associated with adjusting rod 16 to couple with a hook portion 46 associated with a slat 14, to thereby form a hinge coupling element 70, as seen in FIG. 11. Upon release of the compressive forces, (FIG. 12), the entrance 66 to each hook portion 46 becomes more or less surrounded by the slat wall 18 defining an associated opening 32 and by the adjusting rod wall 54, as earlier described, thereby inhibiting the uncoupling of hook portions 46. In practise, and using relatively simple tooling (not shown) the hook portions 46 associated with adjusting rod 16 may be coupled more or less in unison with the hook portions 46 associated with slats 14 previously assembled in shutter frame 12, greatly facilitating the assembly of shutter 10.

Figure 13:
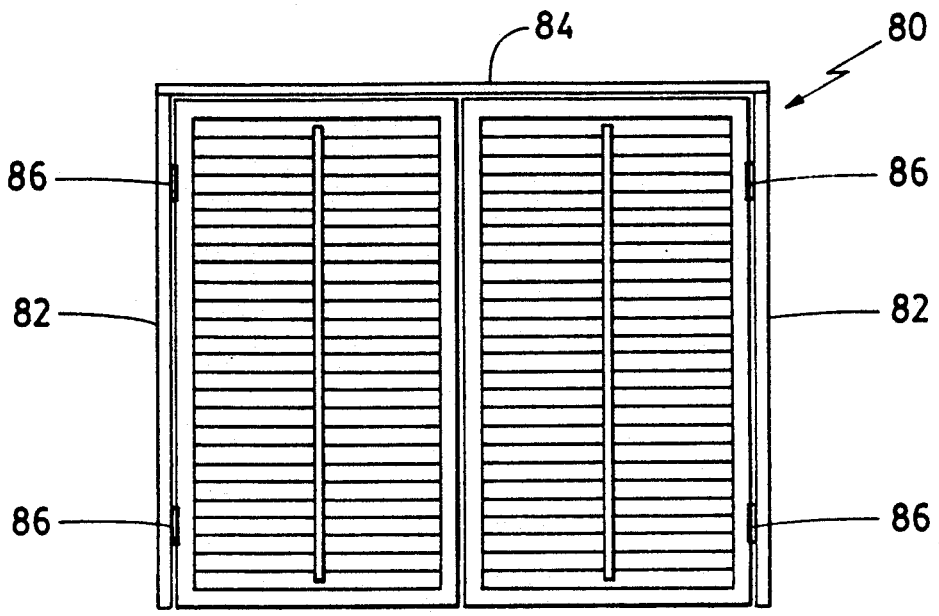
FIG. 13 shows a shutter assembly including shutters and a frame in front elevation.
Figure 14:
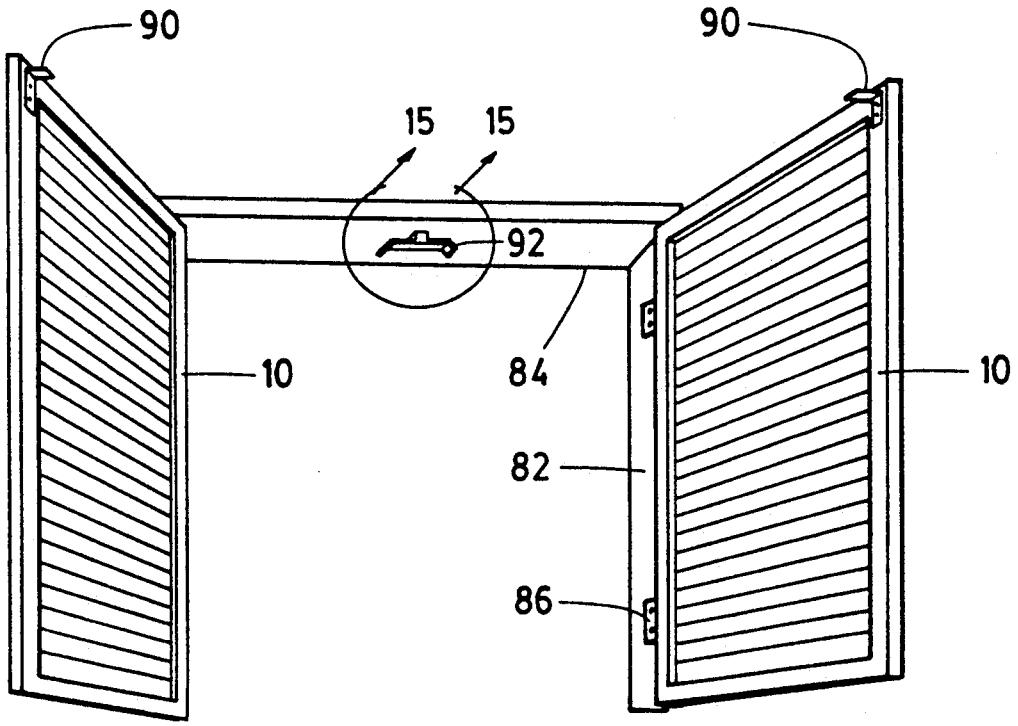
FIG. 14 shows the shutter assembly of FIG. 13 in perspective view from below, with the shutters in an open position.
Figure 15:
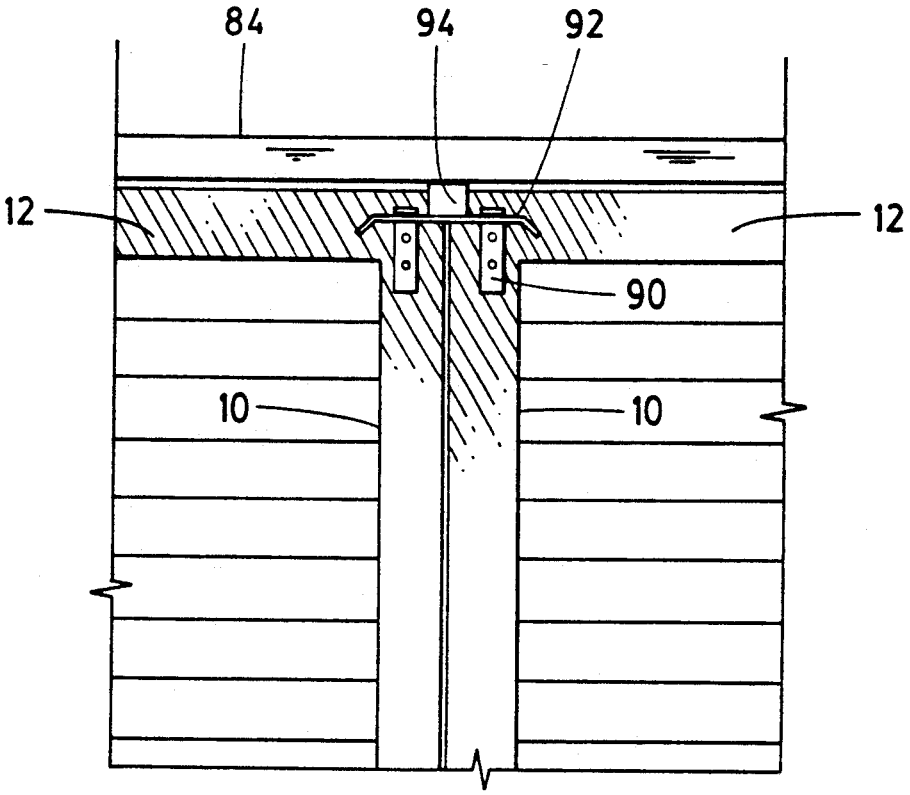
FIG. 15 shows the fragment 15—15 of FIG. 14 in the direction of the arrows, with the shutters closed.
Figure 16:
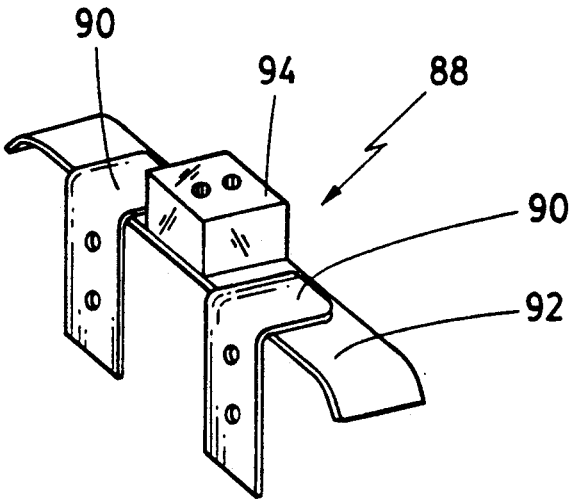
FIG. 16 shows in perspective view a clip means used in the shutter assembly of FIGS. 13-15.

The shutters 10 are formed into a shutter assembly 80 which includes an assembly frame comprising a pair of jambs 82 and a lintel 84. Shutters 10 are respectively secured to jambs 82 by hinges 86 to permit the shutters to move between a closed position, seen in FIG. 13 and an open position, seen in FIG. 14. Shutters 101 particularly where of a hollow plastic construction throughout, tend to sag, this being most noticeable when the shutters are in their closed position, so presenting an aesthetically objectionable appearance. This sagging is relatively easily overcome by the use of a clip means 88 which comprises an L shaped bracket 90 one leg of which is secured to shutter 10 adjacent an upper corner remote from the hinge 86 supporting the shutter, and a support plate 92 secured to the underside of lintel 84 in spaced apart relation thereto using a spacer block 94. Conveniently support plate 92 and block 94 form an abutment stop for shutters 10 as they move to their closed position. Also conveniently due to the frictional resistance of bracket 90 when engaged on support plate 92, the clip means 88 tends to retain shutters 10 in their closed position.

It will be apparent that many changes may be made to the illustrative embodiment while falling within the scope of the invention, and it is intended that all such changes be covered by the claims appended hereto.

I claim:

1. In combination, a shutter slat; elongated in a longitudinal direction and having a tubular wall defined in transverse cross section by a major axis and a minor axis;

said tubular wall having an opening therethrough concentered on said major axis; and a plurality of longitudinally aligned splines depending from said tubular wall internally of said slat on opposed sides of said major axis adjacent said opening; and coupling means for coupling said slat to an adjusting rod, said coupling means including a body portion having a forward end and a rearward end, and an axis therebetween, said body portion having a plurality of serrations transverse to said axis, and a hinge coupling element disposed on the forward end of said body portion, said body portion being inserted through said opening in said slat to engage said serrations with said splines.

2. The combination of claim 1, wherein said splines are longitudinally coextensive with said tubular wall.

3. The combination of claim 2, wherein said slat has a two fold plane of symmetry other than in respect of said opening.

4. The combination of claim 1, wherein said shutter is provided with a stopper at each longitudinal end of said slat thereof and wherein each said stopper includes a trunnion disposed thereon.

5. The combination of claim 4, wherein said body portion has an obround transverse cross section and wherein said serrations are disposed on each of two major surfaces thereof.

6. The combination of claim 5, wherein said hinge coupling element comprises a hook, and said hook is contained in a plane transverse to said serrations.

7. The combination of claim 6, wherein said hook has an entrance and wherein said entrance is normally surrounded by least in part by the wall of said slat defining said opening.

8. The combination of claim 7, wherein said entrance is exposable by deforming said slat by the application of a suitable compressive force along its transverse major axis.

9. The combination of claim 4, wherein said body portion is rearwardly convergent adjacent its rearward end.

10. A shutter comprising a shutter frame:

a plurality of slats;

each of said slats being elongated in a longitudinal direction and having a tubular wall with a transverse cross-section having a major axis and a minor axis;

means pivotally connecting said slats to said shutter frame;

said tubular wall having an opening therethrough concentered on said major axis;

a plurality of splines depending from said tubular wall internally of said slat, said splines locating on opposed sides of said major axis adjacent said opening;

a hollow shutter adjusting rod having transverse cross-section having a major axis and a minor axis, said rod having a plurality of openings therealong, each said opening being concentered on said major axis, said rod having a plurality of inwardly directed splines generally coextensive therewith disposed generally transverse to major axis of said rod on opposed sides thereof, and means coupling said slats to said rod, said coupling means having a central hinge and a pair of serrated portions connected by said hinge;

said serrated portions being respectively inserted through said opening in one of said slats and in one of said openings in said adjusting rod to engage said splines with said serrated portions.

11. The shutter of claim 10, wherein said hinge comprises a pair of hooks coupled together.

12. The shutter of claim 11, wherein one of each said pair of hooks is partially surrounded by the wall of an associated slat defining a said opening therein to inhibit the uncoupling of said hooks.

13. The shutter of claim 12, wherein the other of each of said pair of hooks is partially surrounded by the wall of said adjusting rod defining an associated said opening therein to inhibit the uncoupling of said hooks.

14. The shutter of claim 10, wherein each of said pair of serrated portions includes a convergent end portion which serves to deflect said splines as said serrated portions are urged into engagement therewith.

15. A shutter assembly comprising: a shutter as defined in claim 10, having a rectangular form;

an assembly frame including a pair of jambs and a lintel;

hinge means disposed on one said jamb securing said shutter thereto for movement about a vertical axis between an open and shut positions, and clip means for releasably supporting said shutter when in said shut position from said lintel remote from said jamb on which said hinge means is disposed.

16. The shutter assembly of claim 15, wherein said clip means comprises:

a bracket secured to the frame of said shutter;

a support plate, and means securing said support plate to the underside of said lintel in spaced apart relationship therewith.

17. The shutter assembly of claim 16, wherein said shutter frame is plastic.

18. The shutter assembly of claim 17, wherein said slats are hollow extruded plastic.

19. A shutter assembly comprising the shutter of claim 10:

an assembly frame including a pair of jambs and a lintel;

hinge means disposed on one said jamb securing said shutter thereto for movement between an open and shut positions, and clip means for releasably supporting said shutter when in said shut position from said lintel remote from said jamb on which said hinge means is disposed.

20. The shutter assembly of claim 19, wherein said clip means comprises:

a bracket secured to the frame of said shutter;

a support plate, and means securing said support plate to the underside of said lintel in spaced apart relationship therewith.

* * * * *